US006189544B1

(12) United States Patent
Potut

(10) Patent No.: US 6,189,544 B1
(45) Date of Patent: Feb. 20, 2001

(54) HAIR GRIP WITH PAIRS OF TEETH

(75) Inventor: Jean-Francois Potut, Oyonnax (FR)

(73) Assignee: C.S.P. Diffusion, Arbent (FR)

( * ) Notice: Under 35 U.S.C. 154(b), the term of this patent shall be extended for 0 days.

(21) Appl. No.: 09/493,460

(22) Filed: Jan. 28, 2000

(30) Foreign Application Priority Data

Jan. 29, 1999 (FR) ..... 99 01033

(51) Int. Cl.[7] ..... A45D 8/20
(52) U.S. Cl. ..... 132/277; 132/135
(58) Field of Search ..... 132/277, 135, 132/138, 161

(56) References Cited

U.S. PATENT DOCUMENTS

| | | | | |
|---|---|---|---|---|
| 1,042,940 | * | 10/1912 | Mc Connell | 132/135 |
| 1,819,667 | | 6/1930 | Aaronson . | |
| 2,049,773 | * | 8/1936 | Herschensohn | 132/135 |
| 2,083,761 | * | 6/1937 | Tresenberg | 132/135 |
| 2,171,503 | * | 8/1939 | Huppert | 132/135 |
| 2,712,319 | * | 7/1955 | Rottner | 132/277 |
| 5,549,127 | | 8/1996 | Chang . | |
| 5,787,905 | * | 8/1998 | Yasuda | 132/277 |
| 6,026,827 | * | 2/2000 | Revalis | 132/277 |

FOREIGN PATENT DOCUMENTS

| | | | | |
|---|---|---|---|---|
| 531595 | * | 8/1931 | (DE) | 132/135 |
| 557 331 | | 8/1923 | (FR) . | |
| 934 493 | | 5/1948 | (FR) . | |

* cited by examiner

*Primary Examiner*—Todd E. Manahan
(74) *Attorney, Agent, or Firm*—Ratner & Prestia

(57) ABSTRACT

A hair grip has two elongate one-piece jaws connected by a spring-loaded hinge and delimited by two respective first longitudinal edges, two respective other longitudinal edges. The respective other longitudinal edges each carry spaced curved penetrating teeth extending the jaw on the side opposite the first edges and concave sides of which face toward the teeth of the other jaw to penetrate the hair. These pluralities of penetrating teeth conjointly form a longitudinal succession of pairs of teeth of each respective plurality of teeth. The longitudinal succession of pairs of teeth includes at least one pair of bearing teeth whose end areas are disposed and oriented to rest on or slightly below the surface of the hair, and at least one pair of penetrating teeth offset from each other along said other longitudinal edges of the jaws and which can cross over to penetrate in the hair.

20 Claims, 5 Drawing Sheets

XII

HAIR GRIP WITH PAIRS OF TEETH

BACKGROUND OF THE INVENTION

1. Field of the Invention

The invention relates to a hair grip having two elongate jaws connected by a spring-loaded hinge, which can be placed in the hair to preserve the hairstyle.

The jaws have two respective first longitudinal edges, generally connected by the spring-loaded hinge, and two respective other longitudinal edges each of which has a plurality of longitudinally spaced teeth.

2. Description of the Prior Art

In some hair grips, such as those described in document U.S. Pat. No. 5,549,127 in particular, these spaced teeth are curved and substantially aligned with the jaw on the side opposite the first edges and the teeth of a first jaw have their concave side facing the teeth of the other jaw.

To hold the hair correctly, the teeth of the two jaws are generally shaped so that they can penetrate the hair and cross over therein, close to each other, and thereby grip locks of hair to be held in position.

The teeth are generally close together, and in practice there is a relatively large number of teeth, at least around a half-dozen teeth on each jaw, which provides a large number of closely spaced hair gripping areas. It has become apparent that the hair is heavily loaded in these hair gripping areas, which leads to the risk of damaging the hair, and this risk is more accentuated if the adjacent hair gripping areas are close together.

Furthermore, a good hold on the hair requires relatively thin teeth which penetrate the hair without significantly deforming it. As a result hairs in the vicinity of the hair grip are not significantly displaced, and the esthetic effect of the hair grip is limited to the area it occupies.

Hair grips for holding locks of hair in place during permanent waving are described in document FR 557 331 A or in document FR 934 493 A. The teeth are elongate, only slightly curved, aligned with each other, and do not provide an effective permanent hair grip on the hair.

Document U.S. Pat. No. 1,819,667 A describes a device for waving hair having two toothed jaws each having a toothed secondary member movable longitudinally to wave the hair forcibly. The teeth of the secondary members are divergent and only slightly curved, and the device is not suited to an effective permanent hold in the hair.

An object of the invention is to overcome the drawbacks of the prior art hair grips by enabling a permanent firm hold on locks of hair by a hair grip which minimizes the hair gripping loads likely to break hairs and advantageously has an improved esthetic effect.

SUMMARY OF THE INVENTION

To this end, the invention proposes a hair grip including two elongate one-piece jaws connected by a spring-loaded hinge and delimited by two respective first longitudinal edges and two respective other longitudinal edges, the two respective other longitudinal edges each carrying a plurality of spaced curved penetrating teeth substantially extending the jaw on the side opposite the first edge and concave sides of which face toward the teeth of the other jaw to penetrate the hair, said pluralities of penetrating teeth conjointly forming a longitudinal succession of pairs of teeth of each respective plurality of teeth, the longitudinal succession of pairs of teeth including at least one pair of bearing teeth whose end areas are disposed and oriented to rest on or slightly below the surface of the hair.

The invention stems in particular from the observations that, to hold locks of hair effectively in place, and going against what might be expected, it is not necessary to use penetrating teeth to clamp the hair tightly (and preferably at multiple closely spaced places) in order to hold the hair effectively, provided that the hair grip has other means to maintain its orientation relative to the hair.

Consequently, it can suffice to provide on the jaws additional curved bearing teeth whose end areas bear on the hair to maintain the orientation of the hair grip relative to the hair satisfactorily: because these bearing teeth are offset along the lengthwise direction of the jaws, they maintain the orientation of the hair grip, and the hair grip on the locks of hair may be sufficient. It has also become apparent that these bearing teeth, in addition to maintaining the orientation of the hair grip in the hair, produce attractive waves in the hair around the area occupied by the hair grip. This first esthetic effect is complemented by the fact that the bearing teeth, which penetrate less deeply into the hair than the prior art penetrating teeth, can be wider than the latter (which reinforces the holding effect of the hair grip) and so can, if desired, be readily visible in the hair to provide a hair ornament effect in addition to the holding effect.

The longitudinal succession of pairs of teeth includes at least one pair of penetrating teeth offset from each other along the other longitudinal edges of the jaws and which extend a greater distance toward the other jaw perpendicularly to the associated jaw than the bearing teeth, so that they can cross over. Accordingly, the presence of such penetrating teeth, providing a clamping effect as in the prior art hair grips referred to above, is advantageous because, with the bearing teeth, they assure optimum retention without applying excessive loads to the hair, especially if the penetrating teeth do not need to be too close together, and can advantageously be separated from each other by a pair of bearing teeth (see below).

The longitudinal succession of pairs of teeth preferably also includes at least one pair of penetrating teeth which are shorter than the bearing teeth, and which are more strongly curved than the bearing teeth. Thus the two types of teeth hold different locks of hair with two different forces, which avoids excessively loading the same lock of hair.

In both cases, it is clearly advantageous for the pairs of bearing teeth and the pairs of penetrating teeth to alternate within the longitudinal succession of pairs of teeth to assure a good spacing between the pairs of teeth loading the same lock of hair in the same manner.

At least the pairs of teeth at the ends of the longitudinal succession of pairs of teeth are preferably bearing teeth, which improves how the bearing teeth maintain the orientation of the hair grip. If the penetrating and bearing teeth alternate (see above) the number of penetrating teeth (liable to load the locks of hair heavily) is less than the number of bearing teeth.

The penetrating teeth can have a simple curvature, but they can also have an undulating shape, for example with undulations parallel to the jaws, which strengthens their hold on the hair.

As mentioned above, the bearing teeth are advantageously wider than the penetrating teeth. As a general rule, the bearing teeth advantageously have a massive section (i.e. they are not tapered anywhere along their length), which encourages a good hold on the hair (see above). In a simple first embodiment of the invention, which in particular makes the hair grip clearly visible in the hair (when the hair grip is required to have an ornamental function) the bearing teeth are solid. However, in one beneficial embodiment the bearing teeth are apertured, in the form of a closed loop or fork. Clearly a forked shape strengthens the holding effect. As for the closed loop shape, it can be circular, oval or polygonal (triangular, rectangular, etc.). By analogy with the above remarks concerning the penetrating teeth, the bearing teeth can themselves have an undulating shape to strengthen the effect of the waves produced in the hair. They can have many other shapes, for example that of a twist or a braid, possibly with the same effects.

The spring-loaded hinge connecting the two jaws is advantageously situated on the first longitudinal edges thereof (and thus transversely opposite the toothed longitudinal edges). The invention nevertheless applies equally to a hair grip whose jaws are connected by transverse edges. Depending on the location of the spring-loaded hinge, bearing areas are advantageously formed on the jaws to enable the jaws to be manipulated against the action of said spring loading to enable the hair grip to be applied to the hair.

Objects, features and advantages of the invention will become apparent from the following description, which is given by way of illustrative and non-limiting example only, and with reference to the accompanying drawings.

DETAILED DESCRIPTION OF THE PREFERRED EMBODIMENTS

Figure 2:
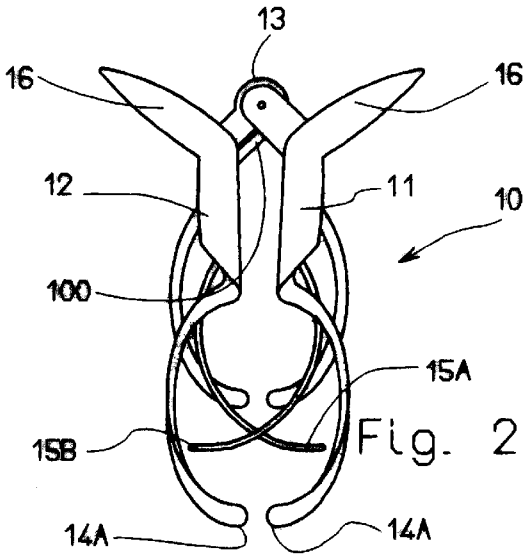
FIG. 2 is an end view of it as seen in the direction of the arrow II in FIG. 1.
Figure 1:
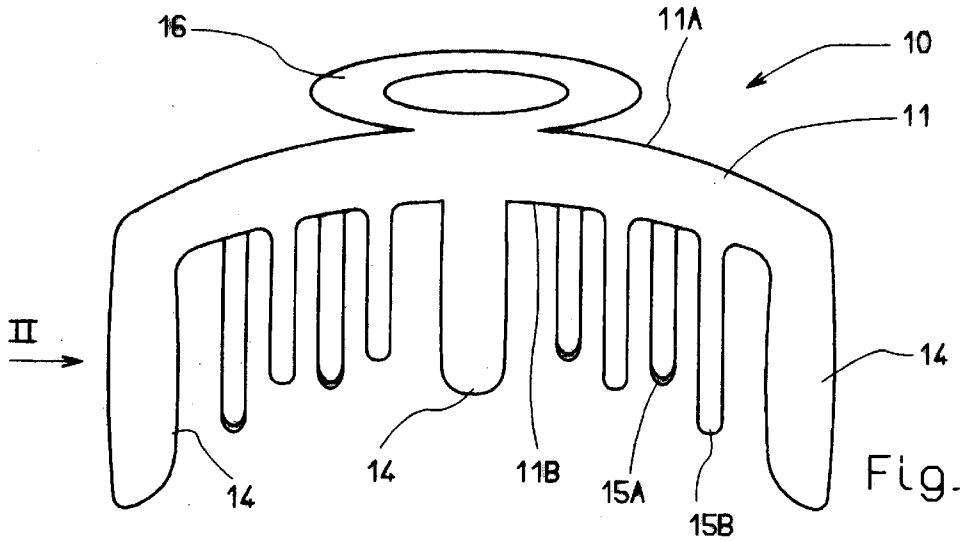
FIG. 1 is a plan view of a first hair grip according to the invention.

FIGS. 1 and 2 show a first hair grip 10 according to the invention.

This hair grip 10 has two elongate one-piece jaws 11 and 12 connected by a spring-loaded hinge 13.

The jaws have respective first longitudinal edges 11A and 12A, and respective other longitudinal edges 11B and 12B.

These longitudinal edges are not necessarily rectilinear or even exactly parallel; this reference to longitudinal edges is merely intended to designate the edges which extend substantially along the direction of the greatest dimension, namely the horizontal direction in FIG. 1.

In practice, the two first longitudinal edges and the two other longitudinal edges are superposed, which is why the longitudinal edges 12A and 12B of the lower jaw, that is to say the jaw which is masked by the jaw 11 in FIG. 1, cannot be seen in the drawing.

Each of the two other longitudinal edges 11B and 12B has a plurality of spaced teeth substantially extending the jaw on the side opposite the first longitudinal edge 11A and 12A, in other words, in FIG. 2, these teeth extend downward. These teeth are preferably curved and their concave sides face toward the teeth of the plurality of teeth on the other jaw. These pluralities of teeth conjointly form a longitudinal succession of pairs of teeth which are respectively part of each plurality of teeth. In the example shown in FIGS. 1 and 2, there are three pairs of bearing teeth 14, the teeth of each pair being substantially identical, with the result that the bearing teeth of the bottom jaw 12 (which cannot be seen in FIG. 1) have the same profile as the bearing teeth of the top jaw 11, which can be seen in FIG. 1.

This succession of three pairs of bearing teeth 14, which are not only substantially identical within each pair but also substantially identical from one pair to the next, have their ends 14*a* spaced apart from each other. FIG. 2 shows that the bottom ends of the teeth continue to be spaced apart from each other when the hair grip is closed.

In the example shown in FIGS. 1 and 2, there are also four pairs of penetrating teeth, like the teeth 15A and 15B, which are shorter and more strongly curved, the penetrating teeth 15A of a first jaw crossing over the penetrating teeth 15B of the second jaw when the hair grip is closed.

Figure 4:
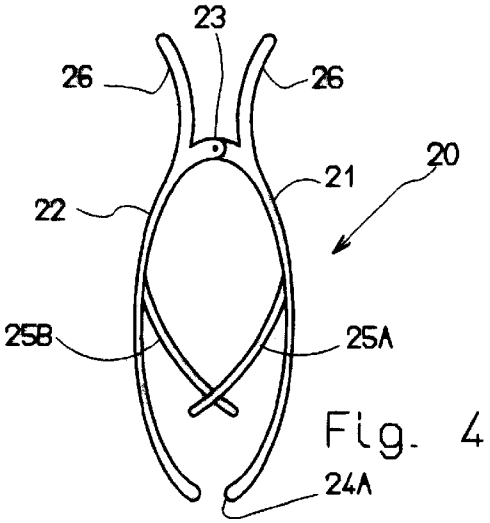
FIG. 4 is an end view of it as seen in the direction of the arrow IV in FIG. 3.
Figure 3:
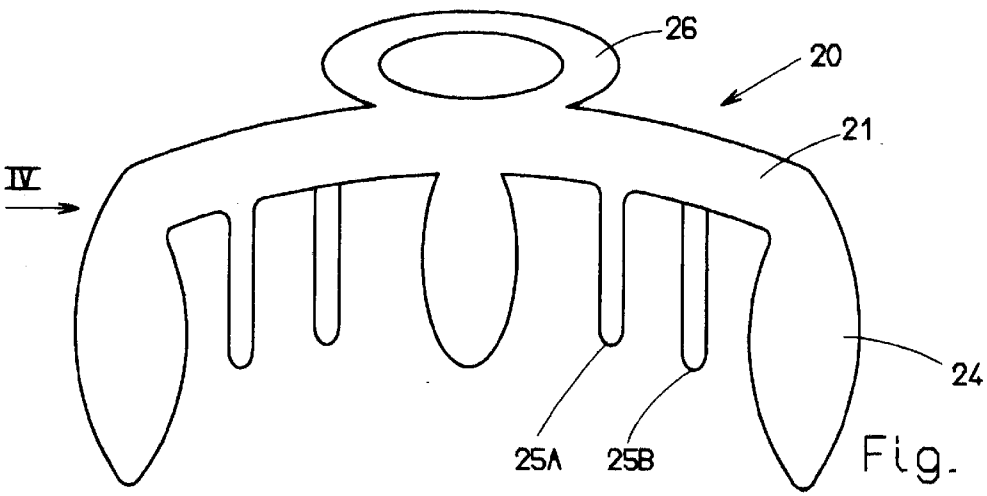
FIG. 3 is a plan view of a second hair grip according to the invention.

FIGS. 3 and 4 show a second hair grip 20 according to the invention.

The components of the hair grip 20 that correspond to components of the hair grip 10 shown in FIGS. 1 and 2 have reference numbers deduced from those used hereabove in FIGS. 1 and 2 by adding 10. Thus the hair grip 20 has elongate one-piece jaws 21 and 22, for example.

The second hair grip 20 differs from the hair grip 10 in the curvature of the teeth and the number of penetrating teeth. There are two pairs of penetrating teeth 25A and 25B, respectively. These pairs of penetrating teeth are offset from each other along the longitudinal edges and extend towards the other jaw perpendicularly to the associated jaw a greater distance than the teeth of the pairs of bearing teeth, so that they cross over. Thus the end of the penetrating tooth 25A shown in FIG. 4, attached to the righthand jaw 21, extends a greater distance toward the left than the end of the bearing tooth 24. Another way to characterize a pair of penetrating teeth is to say that the teeth are shorter than the bearing teeth but more strongly curved than the bearing teeth.

In the example shown, the pairs of penetrating and bearing teeth alternate. To be more precise, the hair grip 20 has three pairs of bearing teeth 24 (left, center and right) and two pairs of penetrating teeth 25A, 25B respectively between the left and center pairs of bearing teeth, and the center and right pairs of bearing teeth.

These pairs of penetrating teeth 25A, 25B are substantially identical to each other; the teeth of each pair are furthermore substantially identical to each other.

The figures, especially FIGS. 2 and 4, show the structure and operation of the bearing teeth 14 and 24. When the hair grip is closed, the free end areas of the bearing teeth 14 and 24 are spaced apart from each other, and so bear on the outside surface of the hair, which they penetrate to only a limited extent, thus remaining on or slightly below the surface of the hair. In contrast, the pairs of more strongly curved penetrating teeth 15A, 15B, 25A, 25B penetrate the hair and cross each other.

The hair grips 10 and 20 hold a lock of hair in place in the hair in a totally satisfactory manner.

Figure 5:
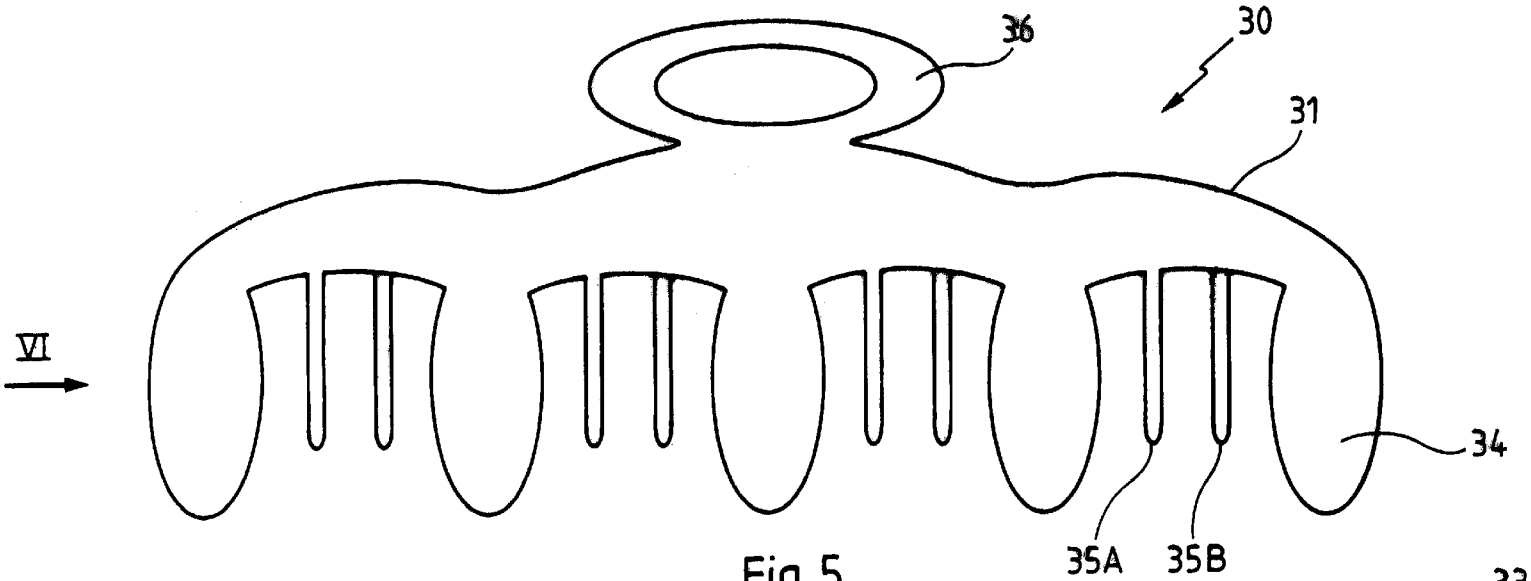
FIG. 5 is a plan view of a variant of the hair grip shown in FIGS. 3 and 4.
Figure 6:
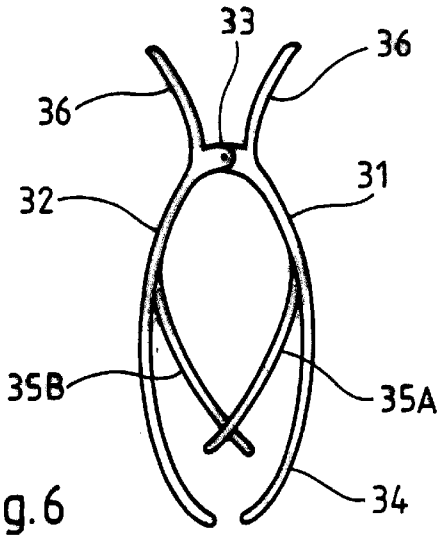
FIG. 6 is an end view of it as seen in the direction of the arrow VI in FIG. 5.

FIGS. 5 and 6 show a variant of the hair grip shown in FIGS. 3 and 4.

This hair grip 30 has a number of components of the same kind as those shown in FIGS. 3 and 4 and these components are identified by reference numbers obtained from those used in FIGS. 3 and 4 by adding 10.

Thus the hair grip 30 includes two elongate one-piece jaws 31 and 32.

The difference between the hair grip 30 and the hair grip 20 is the number of pairs of bearing teeth 34 and penetrating teeth 35A/35B. Like the hair grip 20, the hair grip 30 has alternating pairs of penetrating and bearing teeth, but this hair grip 30 has five pairs of bearing teeth alternating with four pairs of penetrating teeth.

Other types of hair grip in accordance with the invention can be defined. To retain the special feature of the hair grips 20 and 30 whereby the end pairs of teeth are bearing teeth, whilst still alternating the two types of teeth, clearly the number of pairs of bearing teeth must in practice be odd and the number of pairs of penetrating teeth must be the next lower number.

Figure 8:
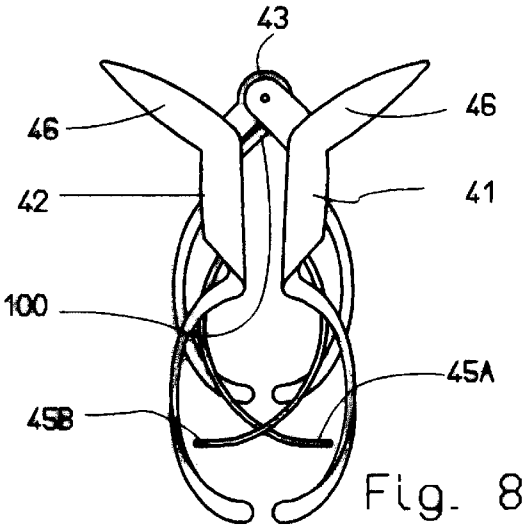
FIG. 8 is an end view of it as seen in the direction of the arrow VIII in FIG. 7.
Figure 7:
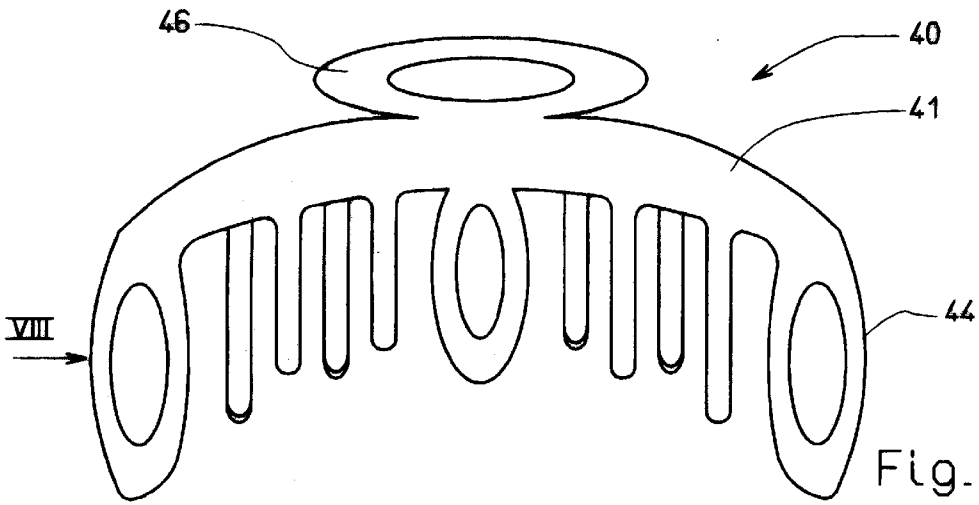
FIG. 7 is a plan view of a third hair grip according to the invention.

FIGS. 7 and 8 show another hair grip 40 according to the invention. It is a variant of the hair grip 10 shown in FIGS. 1 and 2, and components of this hair grip 40 which are similar to components of the hair grip 10 are identified by reference numbers which are deduced from those used in FIGS. 1 and 2 by adding 30.

The hair grip 40 differs from the hair grip 10 shown in FIGS. 1 and 2 in that the three pairs of bearing teeth 44 are apertured, and here of oval shape, instead of being solid and massive like the bearing teeth 14 in the example shown in FIGS. 1 and 2.

Of course, because the apertures in the teeth are perpendicular to the plane of FIGS. 1 and 7, FIGS. 2 and 8 are identical as they show the hair grips 10 and 40 end-on.

Figure 10:
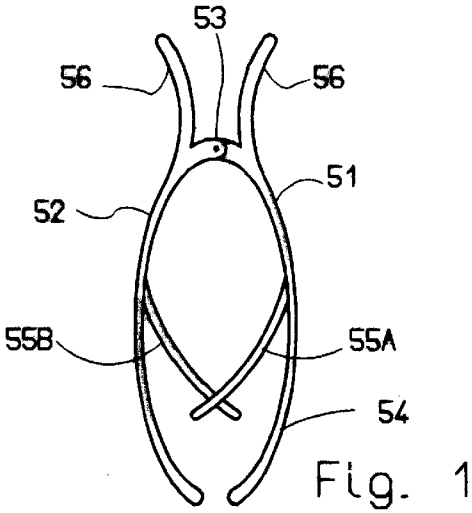
FIG. 10 is an end view of it as seen in the direction of the arrow X in FIG. 9.
Figure 9:
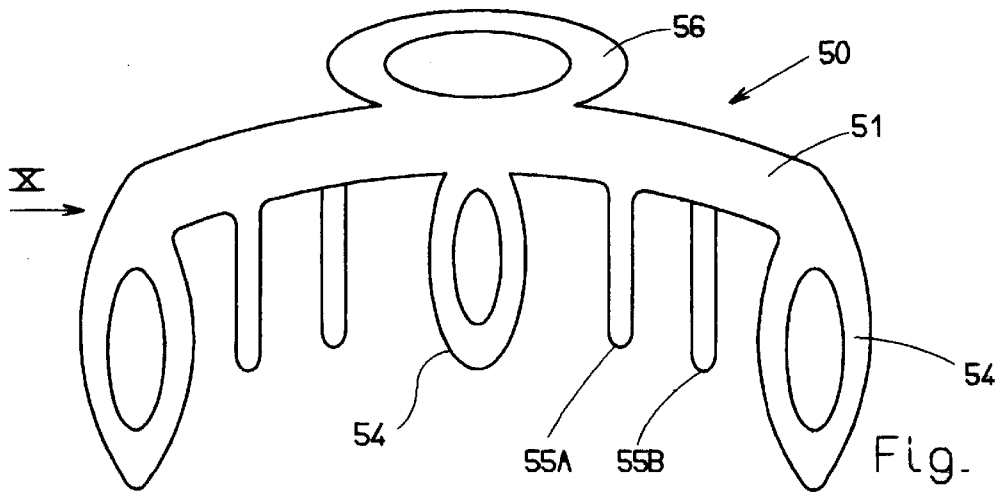
FIG. 9 is a plan view of a fourth hair grip according to the invention having teeth of two different types, including apertured teeth.

FIGS. 9 and 10 show a further hair grip 50 according to the invention.

It is entirely similar to the hair grip 20 shown in FIGS. 3 and 4. Components shown in FIGS. 9 and 10 which are also shown in FIGS. 3 and 4 are identified by reference numbers which are deduced from those used in FIGS. 3 and 4 by adding 30. Thus the hair grip 50 has elongate one-piece jaws 51 and 52, for example.

The difference between the hair grips 20 and 50 is that the teeth shown in FIGS. 3 and 4 have a solid and massive section, as seen clearly in FIG. 3, whereas the teeth shown in FIG. 9 are apertured and have a generally oval shape, as in FIG. 7.

FIGS. 4 and 10 are identical because the modification to the teeth of the first type cannot be seen in cross section.

Figure 12:
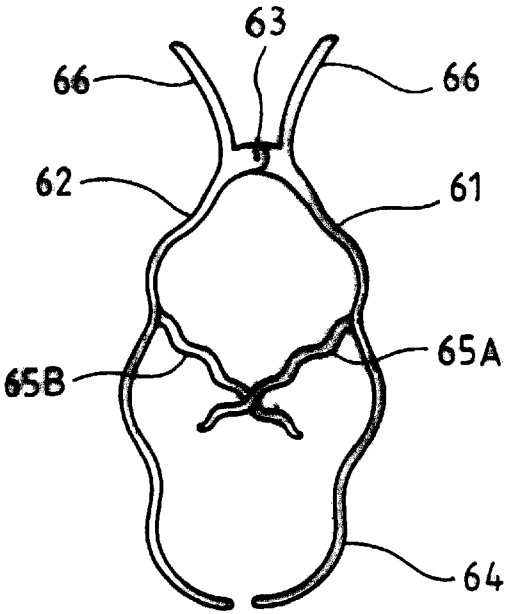
FIG. 12 is an end view of it as seen in the direction of the arrow XII in FIG. 11.
Figure 11:
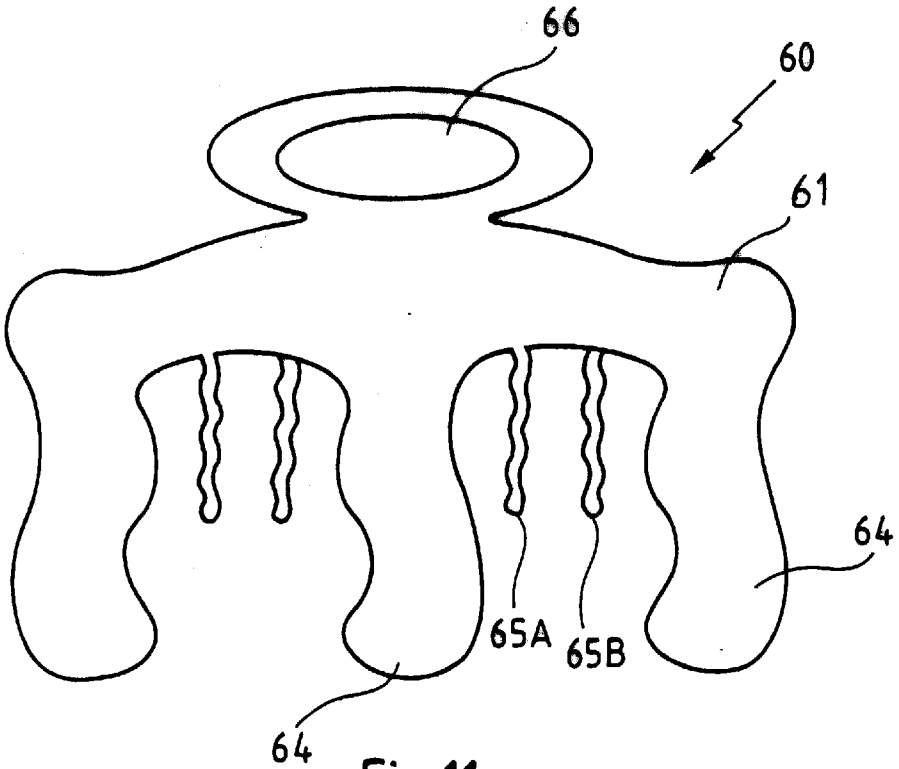
FIG. 11 is a plan view of a fifth hair grip according to the invention having teeth of two types, these teeth having an undulating shape.

FIGS. 11 and 12 show a further embodiment of a hair grip 60 according to the invention. Its components which are similar to components of the hair grip 20 shown in FIGS. 3 and 4 are identified by reference numbers which are deduced from those used in FIGS. 3 and 4 by adding 40. Thus the hair grip 60 has elongate one-piece jaws 61 and 62, for example.

The difference between the hair grip 60 and the hair grip 20 is that the penetrating and bearing teeth, rather than having a substantially regular curvature, as can be seen in a figure such as FIG. 4, also have undulations, as seen equally well in FIG. 11 and in FIG. 12.

Of course, other hair grips can be deduced from any possible combination of the features of the hair grips 20 and 60, for example with massive section bearing teeth as in the hair grip 20, and undulating penetrating teeth as shown in FIGS. 11 and 12. Likewise, the teeth can have undulations either only parallel to the jaws or only perpendicular to the jaws.

FIGS. 13 to 18 show a non-limiting series of shapes for the bearing teeth obtained, for example, by modifying any of the hair grips referred to above.

Figure 13:
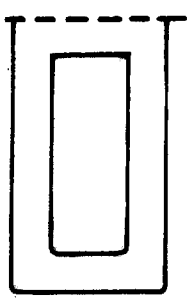
FIG. 13 is a detail view showing a rectangular apertured bearing tooth.

FIG. 13 shows an apertured bearing tooth of generally rectangular shape connected along a shorter side to the edge of the jaw to which the tooth is fixed (symbolized by a dashed line).

Figure 14:
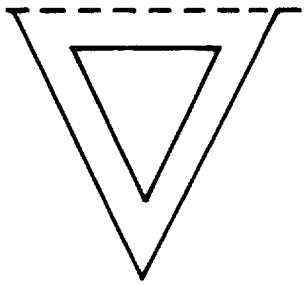
FIG. 14 is a detail view showing a triangular apertured bearing tooth.

FIG. 14 shows a triangular bearing tooth connected to the associated jaw by one side of the triangle. Of course, the tooth could instead be connected to the associated jaw by one apex of the triangle.

Figure 15:
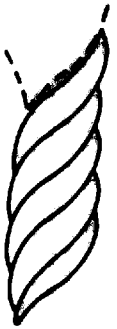
FIG. 15 is a detail view showing another bearing tooth in the shape of a twist.

FIG. 15 shows a bearing tooth with a twist shape.

Figure 16:
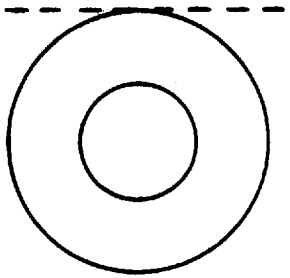
FIG. 16 is a detail view showing an annular bearing tooth.

FIG. 16 shows a bearing tooth whose shape is a substantially circular ring.

Figure 17:
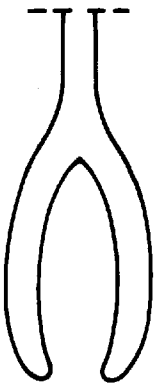
FIG. 17 is a detail view showing a forked bearing tooth.

FIG. 17 shows a bearing tooth which is substantially fork-shaped. It is to be understood that although the shape of the teeth in FIGS. 13, 14 and 16 is that of a closed loop a forked shape would be obtained by eliminating an end part of each tooth (the bottom part as shown in the figures).

Figure 18:
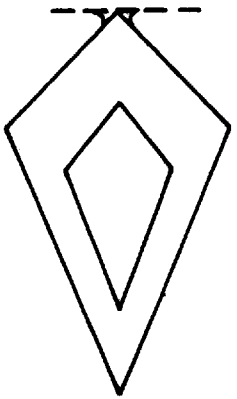
FIG. 18 is a detail view showing an apertured bearing tooth in the shape of a lozenge.

Finally, FIG. 18 shows another shape for the bearing teeth, namely that of a lozenge connected by one apex to the edge of the associated jaw.

Note that, as a general rule, all the penetrating teeth shown in the drawings are much thinner and more tapered than the bearing teeth, whether those of FIGS. 1, 3, 5, 11 or those of FIGS. 7 and 9.

Note that the terms of massive and tapered section used to distinguish the bearing and penetrating teeth relate only to a top view since, as is clear in the end views, the various teeth are advantageously the same thickness.

In the embodiments of the invention shown in the figures, the pairs of bearing teeth comprise two bearing teeth disposed face-to-face with their free ends opposite each other. When the hair grip is closed, a gap can be retained between the ends of the pairs of bearing teeth by providing abutment means 100 (see FIG. 2) to limit relative rotation of the jaws.

Alternatively, the teeth of the pairs of bearing teeth can be offset laterally relative to each other.

Also, in a manner that is well known in the art, each jaw has bearing areas 16 in FIG. 1, 26 in FIG. 3, (and so on for the other hair grips), which areas facilitate placing the hair grip concerned in the hair.

As an alternative to this, not shown, the spring-loaded hinge connecting the two jaws of each hair grip can be near the transverse edges of these jaws, rather than near the first longitudinal edges of the jaws, for example near straight edges of each hair grip.

There is claimed:

1. A hair grip including two elongate one-piece jaws connected by a hinge, said one-piece jaws each comprising a plurality of penetrating teeth concave sides of which face toward said penetrating teeth of the other jaw to penetrate the hair, said pluralities of penetrating teeth forming a longitudinal succession of pairs of teeth, said one-piece jaws each also comprising a plurality of bearing teeth whose end areas are disposed and oriented to rest on or slightly below the surface of the hair, said pluralities of bearing teeth forming pairs of bearing teeth.

2. The hair grip claimed in claim 1 wherein said longitudinal succession of pairs of teeth includes at least one pair of penetrating teeth offset from each other along said jaws and which extend a greater distance toward the other jaw than said bearing teeth, so that they can cross over.

3. The hair grip claimed in claim 1 wherein said longitudinal succession of pairs of teeth includes at least one pair of penetrating teeth which are shorter than said bearing teeth and which are more strongly curved than said bearing teeth.

4. The hair grip claimed in claim 1 wherein said pairs of bearing teeth and said pairs of penetrating teeth alternate within said longitudinal succession of pairs of teeth.

5. The hair grip claimed in claim 1 wherein at least said pairs of teeth at the ends of said longitudinal succession of pairs of teeth are bearing teeth.

6. The hair grip claimed in claim 1 wherein said penetrating teeth have an undulating shape.

7. The hair grip claimed in claim 1 wherein said bearing teeth are solid.

8. The hair grip claimed in claim 1 wherein said bearing teeth are apertured.

9. The hair grip claimed in claim 8 wherein said bearing teeth have a closed loop shape.

10. The hair grip claimed in claim 8 wherein said bearing teeth have a forked shape.

11. The hair grip claimed in claim 1 wherein said hinge connects longitudinal edges of said two jaws.

12. The hair grip claimed in claim 1 wherein said bearing teeth are wider than said penetrating teeth.

13. A hair grip comprising:

two connected elongate jaws;

each of said elongate jaws comprising a plurality of bearing teeth having end areas disposed and oriented to rest on or slightly below the surface of the hair, said bearing teeth of said elongate jaws forming pairs of bearing teeth spaced along the length of said elongate jaws;

each of said elongate jaws further comprising a plurality of penetrating teeth configured to penetrate the hair, at least one of said penetrating teeth on each of said elongate jaws being positioned in the space between adjacent bearing teeth, said penetrating teeth of said elongate jaws forming pairs of penetrating teeth and at least one of said pairs of penetrating teeth is positioned in the space between pairs of said bearing teeth.

14. The hair grip claimed in claim 13 wherein said pairs of bearing teeth include bearing teeth disposed face-to-face with respect to one another.

15. The hair grip claimed in claim 13 wherein said pairs of penetrating teeth include penetrating teeth longitudinally offset from one another.

16. The hair grip claimed in claim 13 wherein said pairs of bearing teeth include bearing teeth disposed face-to-face with respect to one another and said pairs of penetrating teeth include penetrating teeth longitudinally offset from one another.

17. The hair grip claimed in claim 13 wherein said bearing teeth are wider than said penetrating teeth.

18. The hair grip claimed in claim 13 wherein said pairs of bearing teeth and said pairs of penetrating teeth alternate along said elongate jaws.

19. The hair grip claimed in claim 13 wherein said bearing teeth are positioned at end portions of said elongate jaws.

20. The hair grip claimed in claim 13 comprising at least three pairs of bearing teeth and at least two pairs of penetrating teeth, at least one of said pairs of penetrating teeth being positioned between adjacent pairs of said bearing teeth.

* * * * *